US006343948B1

(12) United States Patent
Nutzel

(10) Patent No.: US 6,343,948 B1
(45) Date of Patent: Feb. 5, 2002

(54) PLUG CONNECTOR WITH SNAP-ACTION CLOSURE

(75) Inventor: Peter Nutzel, Nuremberg (DE)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/337,917

(22) Filed: Jun. 22, 1999

(30) Foreign Application Priority Data

Jun. 26, 1998 (DE) ..... 198 28 636

(51) Int. Cl.[7] ..... H01R 13/627
(52) U.S. Cl. ..... 439/358
(58) Field of Search ..... 439/350, 357, 439/358

(56) References Cited

U.S. PATENT DOCUMENTS

| | | | | | |
|---|---|---|---|---|---|
| 5,201,669 | A | * | 4/1993 | Lin | 439/357 |
| 5,207,593 | A | | 5/1993 | Bogiel | 439/352 |
| 5,486,117 | A | * | 1/1996 | Chang | 439/357 |
| 5,674,088 | A | * | 10/1997 | Roche et al. | 439/357 |
| 5,788,527 | A | * | 8/1998 | Sanders et al. | 439/352 |
| 5,806,152 | A | * | 9/1998 | Saitou et al. | 439/352 |
| 5,876,232 | A | * | 3/1999 | Matsushita et al. | 439/357 |
| 6,007,361 | A | * | 12/1999 | Flachslaender | 439/358 |
| 6,010,352 | A | * | 1/2000 | Kameyama | 439/0 |

FOREIGN PATENT DOCUMENTS

| | | |
|---|---|---|
| DE | 296 10 510 U1 | 8/1997 |
| DE | 196 17 819 A1 | 11/1997 |
| EP | 0 477 779 A1 | 4/1992 |

* cited by examiner

*Primary Examiner*—Brian Sircus
*Assistant Examiner*—Javaid Nasri
(74) *Attorney, Agent, or Firm*—Perman & Green, LLP

(57) ABSTRACT

A plug connector (1) is specified which has a plug (2) and a mating connector (3), of which one (2) has latching arms (4) which, during the coupling operation, interact with corresponding latching tabs (5) on the other in order to lock the plug connection, the latching arms (4) having, on their inner side at their free ends, a hook (6) with a chamfered front side (7) and a likewise chamfered rear side (8), as viewed in the plug-in direction, the latching tabs (5) likewise have chamfered front (9) and rear sides (10), with essentially identical angles of inclination in such a way that when latched the respective rear sides (8; 10) of the latching arms (4) and latching tabs (5) lie completely on top of one another, and on their outer sides, between their end connected to the housing and the point at which they rest on the latching tab (5), the latching arms (4) can be pressed in resiliently until the rear side (8) of their respective latching hook pivots around the ridge (11) of the latching tab (5), runs essentially parallel to the plug-in direction and enables the connection to be released.

5 Claims, 2 Drawing Sheets

PLUG CONNECTOR WITH SNAP-ACTION CLOSURE

FIELD OF THE INVENTION

The present invention relates to a plug connector including a plug movable in a plug-in direction between an uncoupled position distant from a mating connector and a coupled position at which latching arms on the plug interact with latching tabs on the connector in order to releasably connect the plug to the connector. This type of locking is popularly known as a snap-action closure.

BACKGROUND OF THE INVENTION

In known snap-action closure systems, a latching arm latches after overcoming a latching tab and can subsequently only be released in an awkward manner. Thus, for example, U.S. Pat. No. 5,207,593 discloses a snap-action closure which is released by wedge-like arms of a stirrup being pushed between the latching arms and the plug housing, in order to spread the latching arms away from the housing and in order thus to move the latching hook on the latching arm and the latching tab arranged on the housing out of engagement, in order to be able to release a plug and its mating connector from each other. In addition, there are plug devices which are described in the printed document EP 0 477 779 A1. Here, the locking of the plug device is carried out by a resilient connecting part (stirrup) being pressed onto the plug device, perpendicular to the plug-in direction of the plug device, and being pushed over locking shoulders. In the process, the connecting part is briefly spread out. Both plugs (plug device) need an additional part, namely the said stirrup or, respectively, the said connecting part, which has to be fitted captively to the housing and requires that the plug or plug device must be accessible on a specific side in order to operate the stirrup or the connecting part.

SUMMARY OF THE INVENTION

The present invention is based on the object of presenting a plug connector with a snap-action closure which is simple to operate and which can be released without additional aids and without great exertion of force.

This object is achieved in accordance with the claims.

Preferred embodiments of the plug connector according to the invention are characterized in the subclaims.

The present invention is based on the idea of configuring the latching arms to be resilient such that a lateral pressure approximately at the centre between the latching arm fixing and its free end leads to the latching hook at the free end of the latching arm being pivoted around the ridge on the latching tab so that the area engaging behind the latching tab is oriented essentially parallel to the plug-in direction, as a result of which the connection becomes easy to release again.

BRIEF DESCRIPTION OF THE DRAWINGS

The invention will be explained in the following text using the description of an exemplary embodiment and with reference to the drawing, in which.

DETAILED DESCRIPTION OF THE INVENTION

Figure 1A:
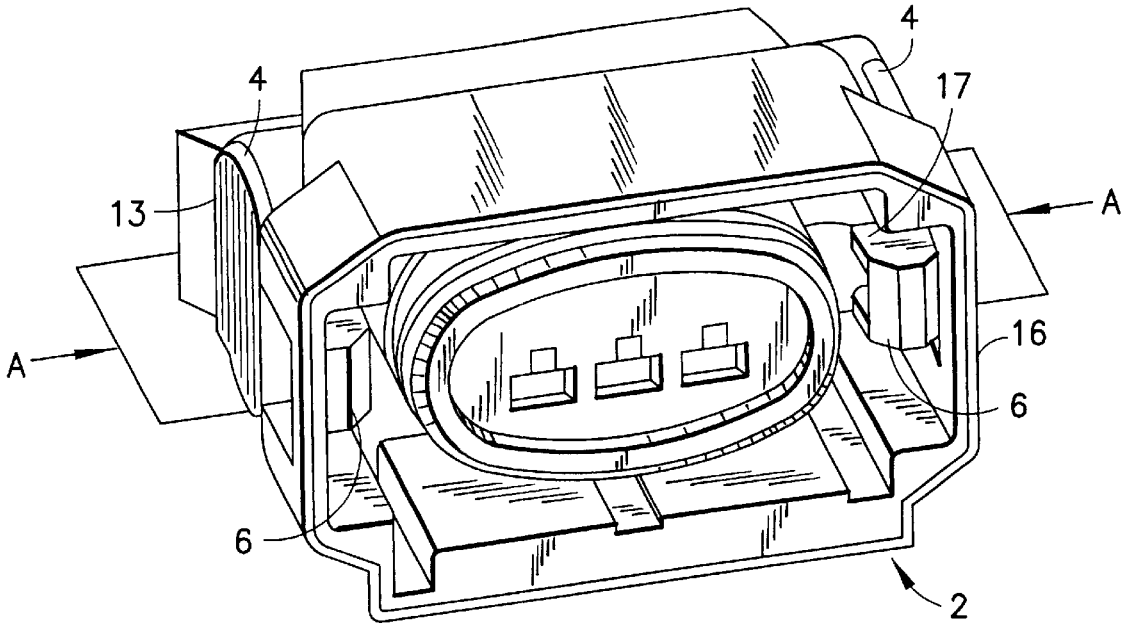
FIG. 1*a* is a perspective view from the front of a plug according to the invention from the front.
Figure 1B:
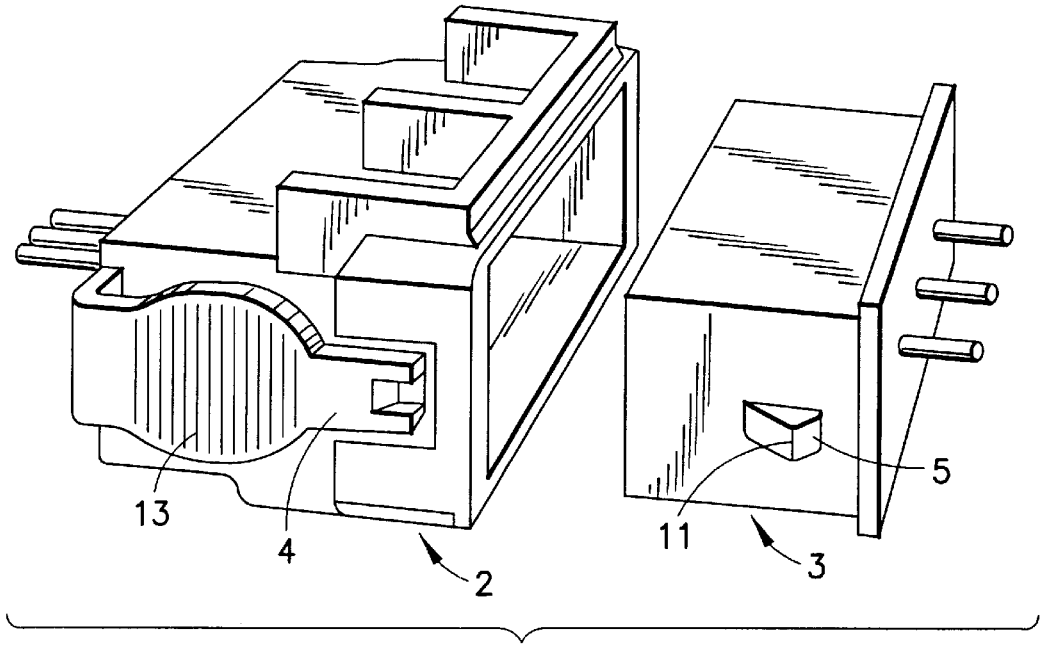
FIG. 1*b* is a perspective exploded view from the side of a plug connector according to the invention in the unplugged state.

FIGS. 1*a* and 1*b* illustrate respectively, one embodiment of a plug and a plug connection according to the invention.

Figure 2A:
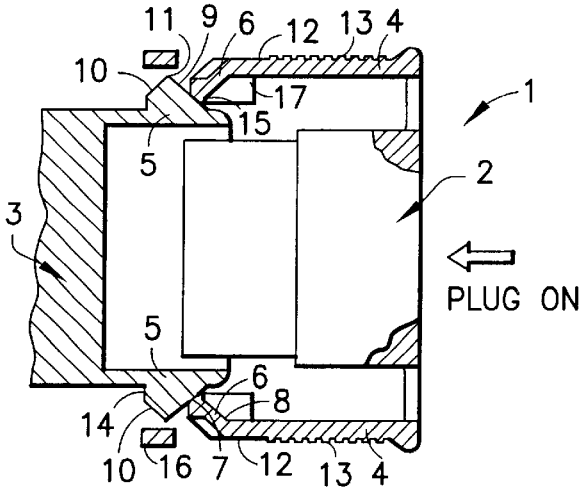
FIGS. 2*a* to 2*c* are cross section views taken generally along line A—A in FIG. 1 illustrating three successive stages during the plugging of a plug onto the corresponding mating connector.
Figure 2B:
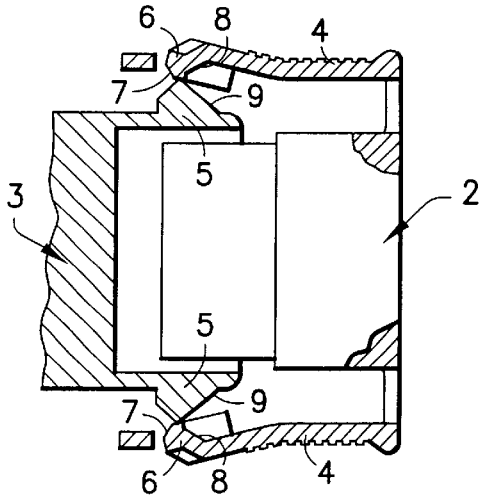

FIG. 2*a* illustrates the plug connector 1 at the instant at which the plug 2 is just touching the latching tab 5 of the mating connector 3 with its latching arms 4. The latching hooks 6 at the free ends of the latching arms 4 have a front side 7 which has approximately the same inclination as the front side 9 of the latching tab 5. Accordingly, as the plug 2 is plugged further onto the mating connector 3, the latching hook 6 slides along on the front faces 9 of the latching tabs 5 and, in the process, spreads apart away from the outer surface of the plug 2 until the ridge 11 of the latching tab is reached by the latching hook 6, which is illustrated in FIG. 2*b*. As the plug 2 is plugged further onto the mating connector 3, the rear side 8 of the latching hook 6 slides down on the rear side 10 of the latching tab until the ridge 11 of the latching tab 5 is resting on the upper end 15 of the rear side 8 of the latching hook 6. The plug connection 1 is thus latched.

Figure 2C:
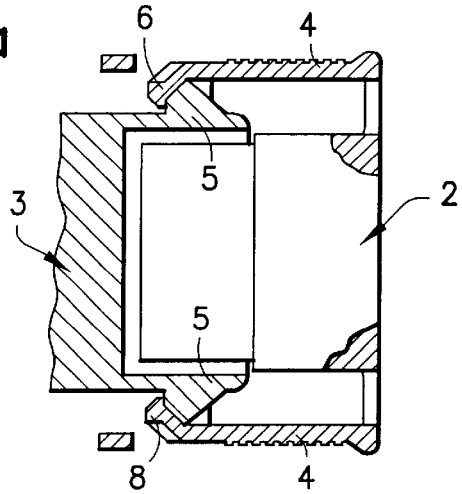

According to a preferred embodiment, the rear side 10 of the latching tab 5 has at its end a region 14 which is perpendicular to the plug-in direction, and the latching hook 6 is correspondingly formed at 15 in the region of its tip, so that the surfaces 14 and 15 are positioned to mutually engage when the latching arms 4 of the plug 2 reach the FIG. 2*c* position. This ensures additional security against being inadvertently dislodged.

Figure 3:
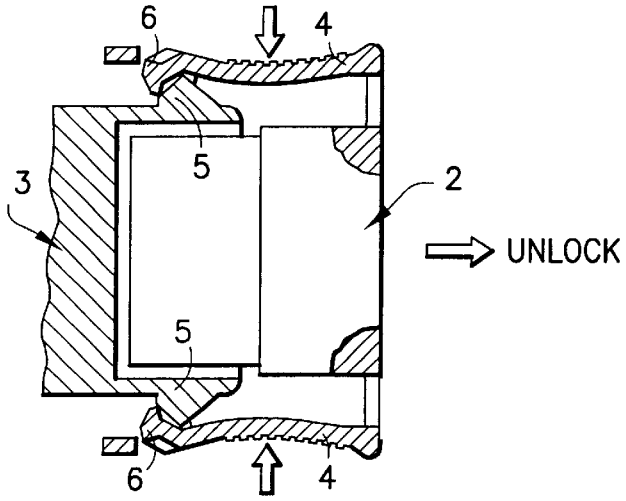
FIG. 3 is a cross section view similar to FIGS. 2*a* to 2*c* illustrating the plug connector when it is being unlocked.

In order to release the plug connection 1, one presses only on the grooved regions 13 between the free end of the latching arms and the ends with which the latching arms are fastened to the plug housing, as a result of which the latching arms bend considerably, as can be seen in FIG. 3. The thickness of the latching arms is selected to enable this operation. During the bending process, the latching hook 6 is pivoted about an axis of rotation which is located on the ridge 11 of the latching tab 5. As a result, the rear side 8 of the latching hook is pivoted away from the rear side 10 of the latching tab 5. In particular, the upper end or tip 15 of the latching arm is lifted off the shoulder 14, which has provided a particular hold. Bending of the latching arms to a great extent has the effect that the rear sides 8 of the latching hooks 6 are lifted a long way from the rear sides 10 and, in the ideal case, run parallel to the plug-in direction. The plug 2 can now be pulled off the mating connector 3 without great exertion.

Since the latching arms have been designed to be bent easily, for the purpose of stably securing the position on the latching tabs 5, a guide tongue 17 is provided on either side of the latching tabs 5 and prevents the latching hooks from being able to escape laterally.

Furthermore, the latching hooks may be formed as part of a protective sleeve 16 of the plug 2, with which they are essentially aligned.

The above description of an exemplary embodiment of the invention serves merely to illustrate the present invention and is not to be understood to be restrictive.

What is claimed is:

1. A plug connector comprising a connector including a pair of spaced apart oppositely facing latching tabs and a mating plug including a pair of spaced apart latching arms, the plug being movable in a plug-in direction between an uncoupled position distant from the connector and a coupled position at which the latching arms interact with the latching tabs in order to releasably connect the plug to the connector, characterized in that the latching arms are resilient in directions transverse of the plug-in direction and are biased toward one another, each of the latching arms extending to a hook, each hook having a hook profile comprising a chamfered rear side and a flat upper end, the flat upper end extending perpendicular to the plug-in direction wherein the hook is located on an inner side of the arms and wherein the latching tabs are oriented toward the exterior of the connector, each latching tab having a tab profile comprising a chamfered rear side and a shoulder, the shoulder extending perpendicular to the plug-in direction, the latching tabs and the hooks being engaged with each other in the coupled position where the hook profile of each hook is disposed adjacent the tab profile of each latching tab wherein, for removal of the plug from the connector from the coupled position, pressure applied to the latching arms to move them toward each other in directions transverse of the plug-in direction causes the hooks to pivot around the latching tabs and with force applied to the plug in a direction opposite to the plug-in direction, moves the plug from the coupled position to the uncoupled position.

2. The plug connector according to claim 1 characterized in that the latching arms have outer sides with grip profiles for increasing friction with the fingers of a user.

3. The plug connector according to claim 1, characterized in that the mating plug includes a sleeve integral with the latching arms, the latching arms having outer sides which are substantially aligned with the sleeve.

4. The plug connector according to claim 1, characterized in that each of the latching hooks on the latching arms has a pair of spaced apart lateral guide tongues aligned with the plug-in direction which, when the plug is in the coupled position, lie on either side of the latching tabs, in order to prevent the latching arms from sliding laterally off the latching tabs.

5. The plug connector according to claim 1 wherein the hook of each latching arm has a chamfered front side disposed opposite the chamfered rear side, the chamfered front and rear sides of one hook facing the chamfered front and rear sides of the other hook, each of the latching tabs similarly having a chamfered front side disposed opposite the chamfered rear side and meeting at a ridge, with substantially similar but oppositely disposed angles of inclination relative to the plug-in direction such that as the plug is moved in the plug-in direction from the uncoupled position toward the coupled position, the hooks of the latching arms engage the front sides of their associated latching tabs and are moved transversely of the plug-in direction until the flat upper ends of the hooks of the latching arms engage, respectively, their associated ridges of the latching tabs and, with further movement in the plug-in direction, engage the rear sides of the latching tabs until the rear sides of the hooks are proximately disposed relative to the rear sides of the latching tabs and, with the ridge of each locking tab engaged with its associated latching arm whereby, upon application of force for removal of the plug from the connector, the hooks pivot around the latching tabs at the ridges.

* * * * *